US006484349B1

(12) United States Patent
Paterson et al.

(10) Patent No.: US 6,484,349 B1
(45) Date of Patent: Nov. 26, 2002

(54) HANDLE ASSEMBLIES FOR FLOOR CARE DEVICES AND METHODS OF USING SAME

(75) Inventors: Chris M. Paterson, Long Beach, MS (US); Shane P. Cohen, New Orleans, LA (US); Jeffrey A. Millard, Long Beach, MS (US); Dennis Lamb, Long Beach, MS (US); Terrance Monty Roberts, Fayetteville, AR (US); Javier Verdura, Milford, CT (US)

(73) Assignee: Oreck Holdings, LLC, Cheyenne, WY (US)

( * ) Notice: Subject to any disclaimer, the term of this patent is extended or adjusted under 35 U.S.C. 154(b) by 0 days.

(21) Appl. No.: 09/675,474

(22) Filed: Sep. 29, 2000

Related U.S. Application Data

(63) Continuation-in-part of application No. 29/116,352, filed on Dec. 30, 1999, now Pat. No. Des. 435,153, and a continuation-in-part of application No. 29/116,364, filed on Dec. 30, 1999, now Pat. No. Des. 435,323, and a continuation-in-part of application No. 29/116,370, filed on Dec. 30, 1999, now Pat. No. Des. 435,709, and a continuation-in-part of application No. 29/116,371, filed on Dec. 30, 1999, now Pat. No. Des. 450,897.

(51) Int. Cl.[7] ..... A47L 9/26; A47L 9/32
(52) U.S. Cl. ..... 15/323; 15/410; 242/400.1
(58) Field of Search ..... 15/323, 410; 242/400.1

(56) References Cited

U.S. PATENT DOCUMENTS 1,746,246 A * 2/1930 Elworthy ..... 242/400.1
2,037,668 A * 4/1936 Smith et al. ..... 242/400.1

(List continued on next page.)

FOREIGN PATENT DOCUMENTS

DE 4037889 * 12/1991 ..... 15/410

OTHER PUBLICATIONS

Oreck Product Brochure, "Nothing Gets By an Oreck Celoc® Hypo–Allergenic 8 Lb. Hotel Upright," 1 page, Jun. 1985.

1997 Oreck Product Catalog, "Oreck. Simply Amazing," pp. 1–2.

*Primary Examiner*—Chris K. Moore
(74) *Attorney, Agent, or Firm*—Faegre & Benson LLP

(57) ABSTRACT

Handle assemblies for floor care devices, and methods for using the same, are disclosed. In one embodiment, a handle apparatus includes a main member partially surrounding a cord retaining space that is adapted to receive a plurality of portions of a power cord of the floor care device. A retaining member is moveably attached to the main member, and includes a retaining surface that is positionable proximate the cord retaining space. In a first or "retaining" position, the retaining surface retains the plurality of power cord portions within the cord retaining space, and in a second or "releasing" position, the retaining surface releases the plurality of power cord portions from the cord retaining space. In alternate embodiments, the retaining member may be rotatably, pivotably, or slidably attached to the main member, pivotably attached to the main member. In another embodiment, a handle assembly includes a main member having a grip portion adapted to be held by an operator of the floor care device, and a base portion attached to the grip portion. The base portion includes an attachment portion adapted to attach to an attachment end of a handle support, and a receiving portion adapted to attach to a first end of a power cord. A support axis projects axially outwardly from the attachment end of the handle support into the attachment portion, and a first axis projects axially outwardly from the first end of the power cord into the receiving portion such that the first axis is approximately parallel to the support axis.

39 Claims, 7 Drawing Sheets

U.S. PATENT DOCUMENTS

D218,550 S 9/1970 Friedman
3,639,941 A 2/1972 Kirwan et al.
3,654,661 A 4/1972 Scott
D238,849 S 2/1976 Jones
3,971,643 A 7/1976 Hufton
4,554,698 A 11/1985 Rennecker et al.
4,559,665 A 12/1985 Fitzwater
4,566,884 A 1/1986 Jones et al.
D287,894 S 1/1987 Watkins et al.
4,648,149 A 3/1987 Hampton et al.
D292,335 S 10/1987 Wareham et al.
4,707,169 A * 11/1987 Wareham et al. ..... 15/410 X
4,720,890 A * 1/1988 Jacob ..... 15/323
D294,988 S 3/1988 Goodrich
4,733,430 A 3/1988 Westergren
D296,486 S 6/1988 Staubitz et al.
4,782,552 A 11/1988 Bartlett et al.
4,809,393 A * 3/1989 Goodrich et al. ..... 15/323
D305,168 S 12/1989 Kroll
D305,373 S 1/1990 Yamamoto et al.
D309,806 S 8/1990 Chieda et al.
D315,623 S 3/1991 Bartasevich et al.
5,016,315 A 5/1991 Bledsoe et al.
5,228,169 A 7/1993 Stein et al.
5,230,121 A 7/1993 Blackman
D339,433 S 9/1993 Stein et al.
D345,830 S 4/1994 Furcron et al.
D346,468 S 4/1994 Dusinberre et al.
D347,504 S 5/1994 Furcron et al.
5,331,714 A * 7/1994 Essex et al. ..... 15/323
5,367,741 A 11/1994 Hampton et al.
5,390,392 A 2/1995 Thomas et al.
D364,014 S 11/1995 Langeland et al.
5,606,770 A 3/1997 Sovis et al.
D379,692 S 6/1997 Abe
5,651,581 A 7/1997 Myers et al.
D387,517 S 12/1997 Abe et al.
D396,919 S 8/1998 Henderson
D398,097 S 9/1998 Murphy et al.
D398,723 S 9/1998 Diebel
D399,615 S 10/1998 Hajjar et al.
5,819,370 A 10/1998 Stein
5,839,160 A 11/1998 Wang et al.
D403,480 S 12/1998 Diebel
D405,569 S 2/1999 Rowley et al.
5,887,315 A 3/1999 Rogers
5,906,024 A 5/1999 Jailor et al.
5,911,261 A 6/1999 Farone et al.
5,933,911 A 8/1999 Windmeisser
D415,324 S 10/1999 Wang et al.
D424,261 S 5/2000 Embree et al.
D426,038 S 5/2000 Essex et al.
D426,357 S 6/2000 Tsuruha et al.
6,079,080 A 6/2000 Rutter et al.
6,106,182 A * 8/2000 Hamm et al. ..... 15/410 X
6,243,916 B1 * 6/2001 Embree et al.

* cited by examiner

HANDLE ASSEMBLIES FOR FLOOR CARE DEVICES AND METHODS OF USING SAME

CROSS-REFERENCE TO RELATED APPLICATIONS

This application is a continuation-in-part of U.S. patent application No. 29/116,352, filed Dec. 30, 1999, now U.S. Design Pat. No. D,435,153; U.S. patent application No. 29/116,364, filed Dec. 30, 1999, now U.S. Design Pat. No. D,435,323; U.S. patent application No. 29/116,370, filed Dec. 30, 1999, now U.S. Design Pat. No. D,435,709; and U.S. patent application No. 29/116,371, filed Dec. 30, 1999, now U.S. Design Pat. No. D,450,897.

TECHNICAL FIELD

The present invention relates to handle assemblies for floor care devices, such as vacuums, buffers, extractors, and the like, and methods for using the same.

BACKGROUND OF THE INVENTION

Many contemporary floor care devices are electrically powered. Such floor care devices include vacuums, buffers, extractors, steam cleaners, sweepers, carpet shampooers and other similar devices. The electrical power is typically supplied to the floor care device through a power cord that is temporarily or permanently attached to the floor care device.

FIG. 1 is a side elevational view of a floor care device 10 (e.g. an upright vacuum) in accordance with the prior art. As is well known, the floor care device 10 includes a vacuum head 40 that engages a floor surface 12, and a dirt containment tank 16 coupled to the vacuum head 40 for receiving and storing particulates. An exhaust duct 18 extends between the vacuum head 40 and the containment tank 16, and a handle support 30 extends upwardly from the containment tank 16. A handle assembly 20 is attached to an upper end of the handle support 30. The handle assembly 20 includes a control switch 21. A power cord 28 is attached to the handle assembly 20 and may extend to a power supply (not shown), such as an electrical outlet. An upper cord hook 32 is attached to the handle assembly 20, and a lower cord hook 34 is attached to the handle support 30.

In use, an operator grips the handle assembly 20 and actuates the control switch 21 to transmit power supplied by the power cord 28 to the vacuum head 40. As will be understood by persons of ordinary skill in the art, the vacuum head 40 includes an airflow propulsion device (not shown) that creates suction at the floor surface 12, drawing a particulate-laden airstream from the floor surface 12 into the vacuum head 40. The airflow propulsion device propels the particulate-laden airstream through the exhaust duct 18 and into the dirt containment tank 16, where the particulates may be filtered from the particulate-laden airstream and stored for later disposal. When not in use, the operator may prepare the floor care device 10 for transport and storage by successively winding or wrapping the power cord 28 about the upper and lower cord hooks 32, 34 to place the power cord 28 in a stowed position 50 (FIG. 1).

Typically, the dirt containment tank 16 is pivotably coupled to the vacuum head 40. This advantageously permits the operator to tilt the containment tank 16 (and the handle support 30 and handle assembly 20) into an inclined position (not shown), allowing the operator to move the vacuum head 40 under tables, desks, or other furnishings. In many applications, the containment tank 16 may freely pivot so that the operator may incline the handle support 30 until the handle assembly 20 contacts (or nearly contacts) the floor surface 12.

Although desirable results have been achieved using the floor care device 10, some possible drawbacks exist. For example, when the operator desires to prepare the floor care device 10 for transport and storage, the operator must successively wind the power cord 28 about the upper and lower cord hooks 32, 34. Due to the configuration of the upper and lower cord hooks 32, 34, this may be tedious and time-consuming. Furthermore, the next time the operator desires to use the floor care device 10, the power cord 28 must be successively unwound from the upper and lower cord hooks 32, 34. This may also be tedious and time-consuming.

Another possible drawback may occur during wrapping or unwrapping of the power cord 28 from the upper and lower cord hooks 32, 34. For example, when the operator begins wrapping the power cord 28 about the lower cord hook 34, the operator may pull downwardly on the power cord 28 before drawing the power cord 28 about the lower cord hook 34 and then upwardly to the upper cord hook 32. This action may cause the power cord 28 to bend sharply at a point of attachment 29 between the power cord 28 and the handle assembly 20. This sharp bending may subject the power cord 28 to bending stresses that may fatigue and ultimately damage the power cord 28.

Yet another possible drawback is that when the containment tank 16 is fully inclined, the handle assembly 20 may be lowered until a portion of the power cord 28 near the point of attachment 29 contacts the floor surface 12. This may also cause undesirably large bending stresses to develop in the power cord 28 at the point of attachment 29 that may eventually damage the power cord 28. The undesirable bending stresses may be particularly acute if the operator accidentally releases the handle assembly 20, allowing the portion of the power cord 28 near the point of attachment 29 to strike the floor surface 12.

SUMMARY OF THE INVENTION

The present invention is directed to handle apparatus for floor care devices, such as vacuums, buffers, extractors, and the like, and methods for using the same. In one aspect, a handle assembly for a floor care device includes a main member partially surrounding a cord retaining space that is adapted to receive a plurality of loops of a power cord of the floor care device. A retaining member is moveably attached to the main member, and includes a retaining surface that is positionable proximate the cord retaining space. In a first or "retaining" position, the retaining surface retains the plurality of power cord loops within the cord retaining space, and in a second or "releasing" position, the retaining surface releases the plurality of power cord loops from the cord retaining space. The retaining member may be rotatably, pivotably, or slidably attached to the main member. This permits the loops of the power cord to be quickly and conveniently wrapped or unwrapped from the handle assembly.

In another aspect, a handle assembly for a floor care device includes a main member having a grip portion adapted to be held by an operator of the floor care device, and a base portion attached to the grip portion. The base portion includes an attachment portion adapted to attach to an attachment end of a handle support, and a receiving portion adapted to attach to a first end of a power cord. A support axis projects axially outwardly from the attachment end of the handle support into the attachment portion, and a first axis projects axially outwardly from the first end of the power cord into the receiving portion such that the first axis is approximately parallel to the support axis. Accordingly, when the power cord is wrapped in a stowed position, undesirable bending stresses in the power cord may be reduced or eliminated.

DETAILED DESCRIPTION OF THE INVENTION

The present invention is generally directed to handle assemblies for floor care devices, and methods for using the same. Many specific details of certain embodiments of the invention are set forth in the following description and in FIGS. 2–9 to provide a thorough understanding of such embodiments. One skilled in the art will understand, however, that the present invention may have additional embodiments, or that the present invention may be practiced without several of the details described in the following description.

Figure 2:
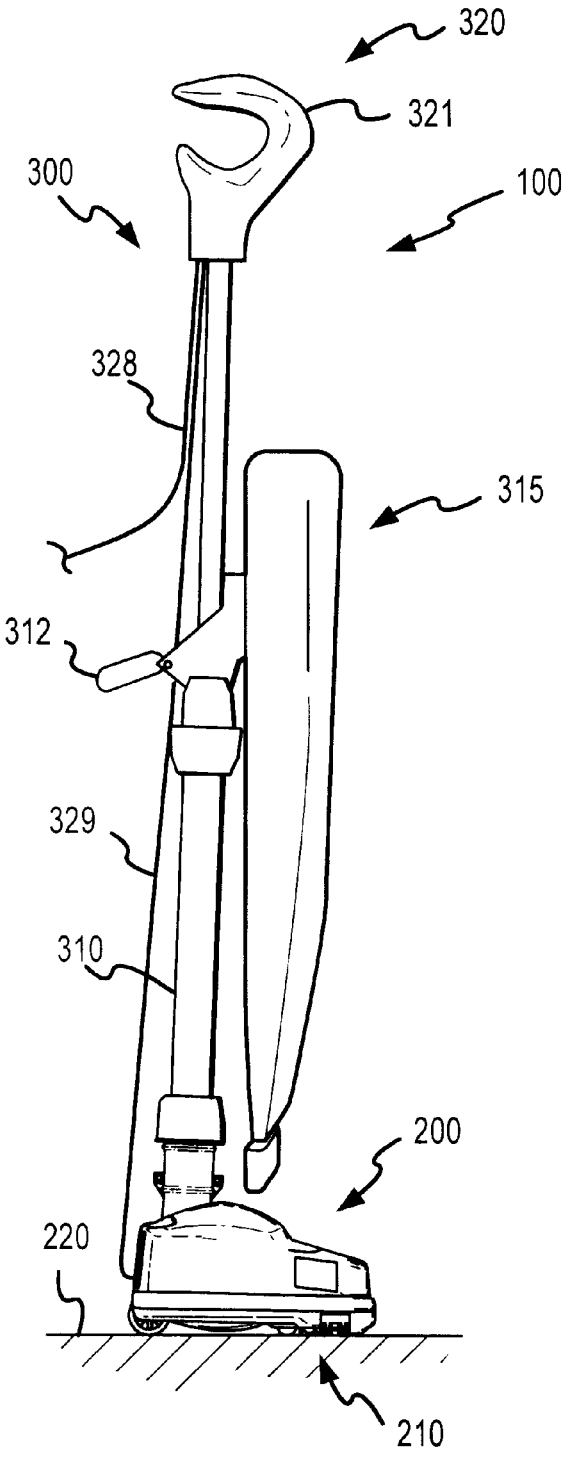
FIG. 2 is a side elevational view of a floor care apparatus having a handle in accordance with an embodiment of the invention.

FIG. 2 is a side elevational view of a floor care device 100 having a handle assembly 320 in accordance with an embodiment of the invention. In this embodiment, the floor care device 100 is an upright vacuum cleaner. The floor care device 100 includes a vacuum head 200 having an intake aperture 210 positioned close to a floor surface 220. A handle support 300 is pivotably coupled to the vacuum head 200 and extends upwardly from the vacuum head 200 to the handle assembly 320, enabling an operator to move the vacuum head 200 along the floor surface 220. As described more fully below, the handle assembly 320 provides several desirable advantages over prior art handle assemblies.

Figure 3:
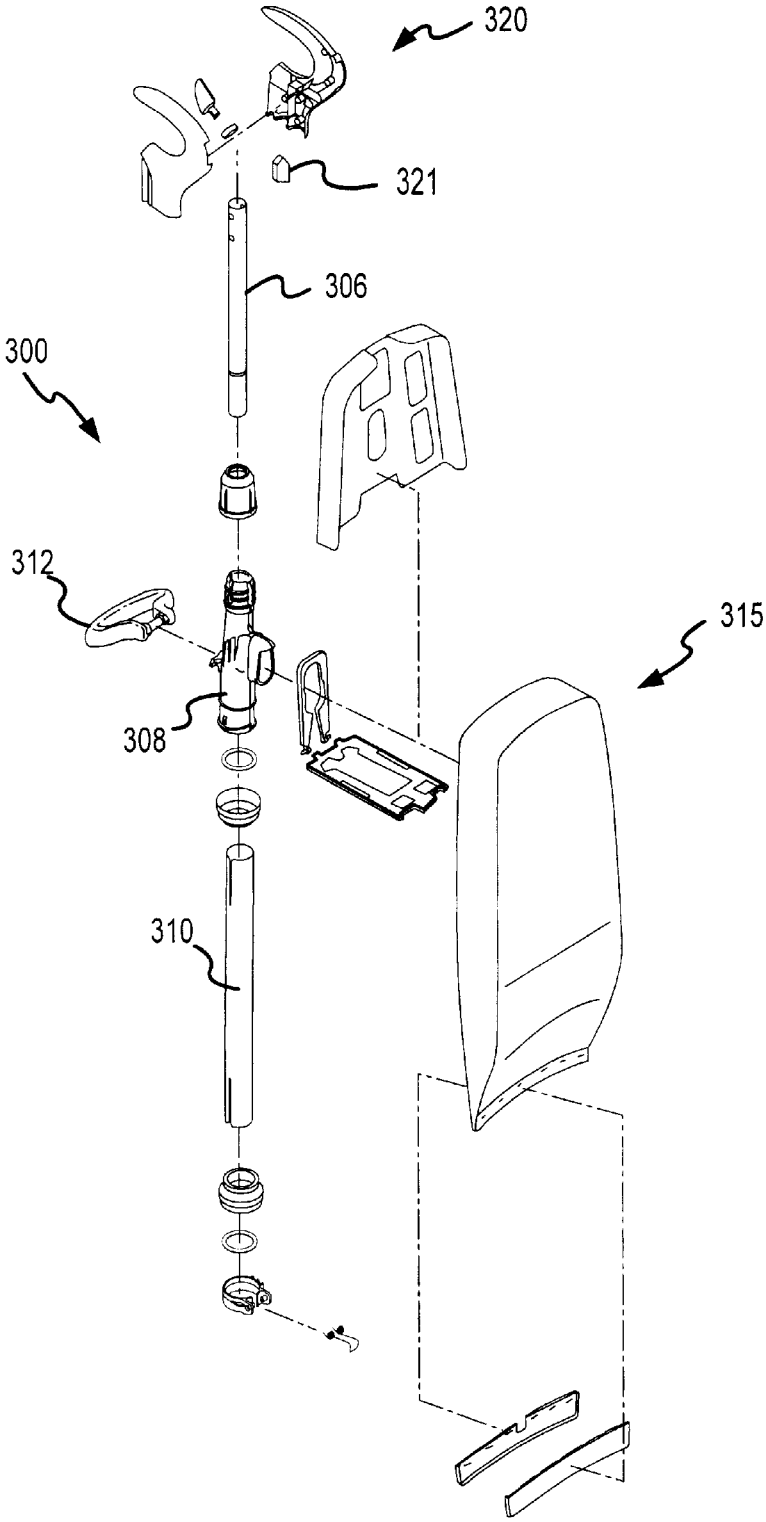
FIG. 3 is an exploded isometric view of an upper portion of the floor care apparatus of FIG. 2.

FIG. 3 is an exploded isometric view of an upper portion of the floor care device 100 of FIG. 2. As shown in FIG. 3, the handle support 300 includes an exhaust conduit portion 310, a mid-handle connector 308, and a handle tube 306. The handle tube 306 attaches to and extends downwardly from the handle assembly 320 into the mid-handle connector 308. The mid-handle connector 308 couples the handle tube 306 to the exhaust conduit portion 310 and provides a flow conduit for a particulate-laden airstream exiting from the exhaust conduit portion 310. An outer bag 315 is operatively coupled to the mid-handle connector 308 to receive the particulate-laden airstream from the exhaust conduit portion 310. A secondary handle 312 may be attached to the mid-handle connector 308. The secondary handle 312 may be moveable between an extended position (see FIG. 2) and a folded position adjacent the handle tube 306 (not shown). As best shown in FIG. 2, a power cord 328 is attached to the handle assembly 320. A control cord 329 extends between the handle assembly 320 and the vacuum head 200. A control switch 321 is disposed in the handle assembly 320. The control switch 321 is operatively coupled to the power cord 328 and to the control cord 329 to permit the operator to control the supply of power to the vacuum head 200.

Figure 4:
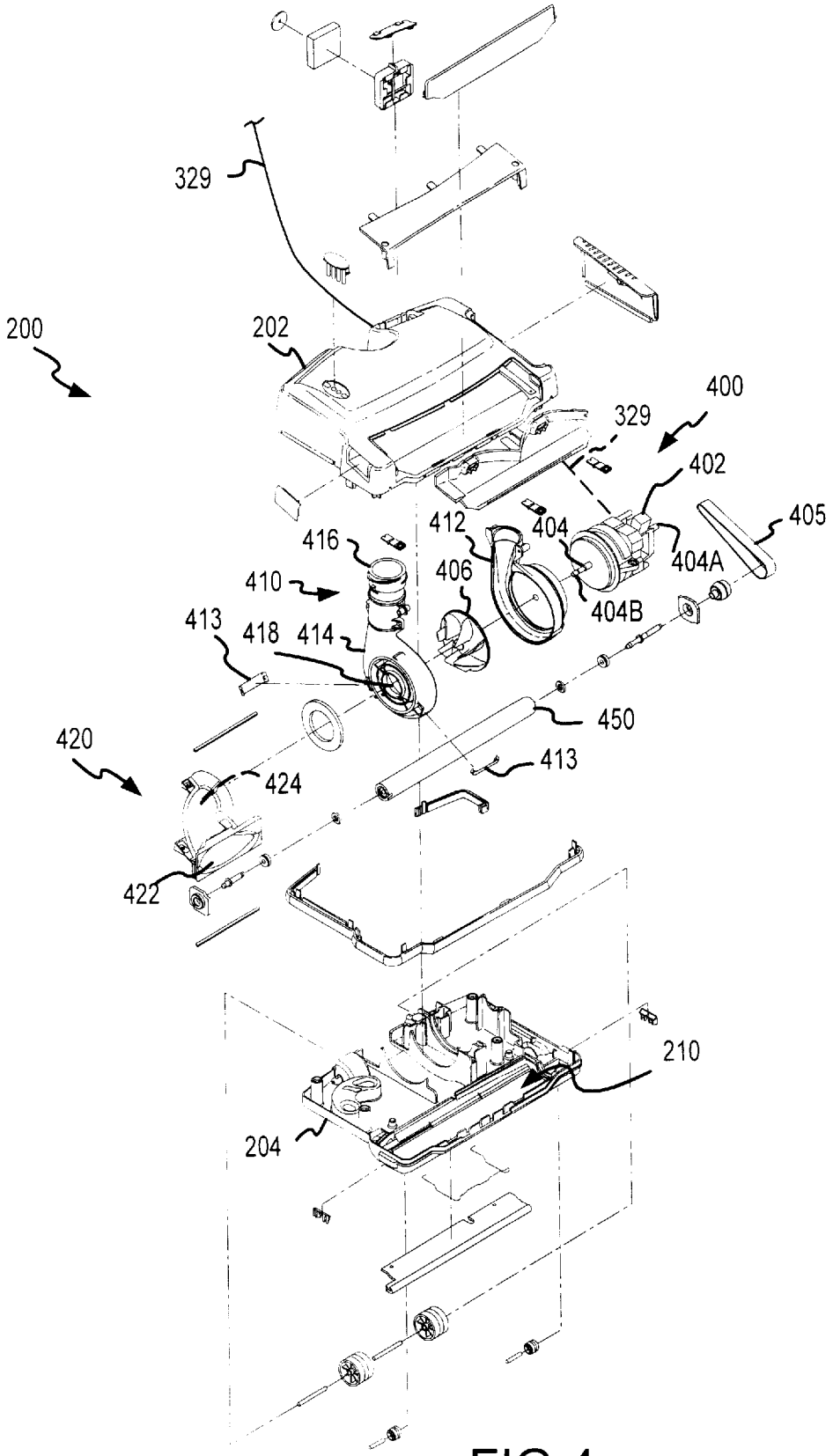
FIG. 4 is an exploded isometric view of a lower portion of the floor care apparatus of FIG. 2.

FIG. 4 is an exploded isometric view of a lower portion of the floor care device 100 of FIG. 2. As shown in FIG. 4, the vacuum head 200 includes an upper housing 202 and a bottom plate 204. An airflow propulsion device 400 is disposed within the vacuum head 200 between the upper housing 202 and the bottom plate 204. The airflow propulsion device 400 includes a motor 402 operatively coupled to the control cord 329 and having a drive shaft 404 that engages a belt 405 coupled between a first end 404*a* of the drive shaft 404 and a rotatable roller brush 450. As the motor 402 turns, the drive shaft 404 drives the roller brush 450 via the belt 405.

The airflow propulsion device 400 also includes a fan 406 coupled to a second end 404*b* of the drive shaft 404 and disposed within a fan housing 410. The fan housing 410 includes first and second halves 412, 414 held together by fasteners 413. A coupling portion 416 of the fan housing 410 is connected to the exhaust conduit portion 310 of the handle support 300 (FIG. 3). The airflow propulsion device 400 further includes a suction duct 420 having a suction inlet 422 in fluid communication with the intake aperture 210, and a suction outlet 424 coupled to a central intake 418 of the fan housing 410.

In operation, an operator actuates the control switch 321 to transmit power supplied by the power cord 328 through the control cord 329 to the vacuum head 200. As will be understood by persons of ordinary skill in the art, the airflow propulsion device 400 creates suction at the intake aperture 210, drawing a particulate-laden airstream from the floor surface 220 through the intake aperture 210 and into the vacuum head 200. The airflow propulsion device 400 propels the particulate-laden airstream through the exhaust conduit portion 310 of the handle support 300, through the mid-handle connector 308, and into the outer bag 315, where the particulates may be filtered from the particulate-laden airstream and stored for later disposal.

Figure 5:
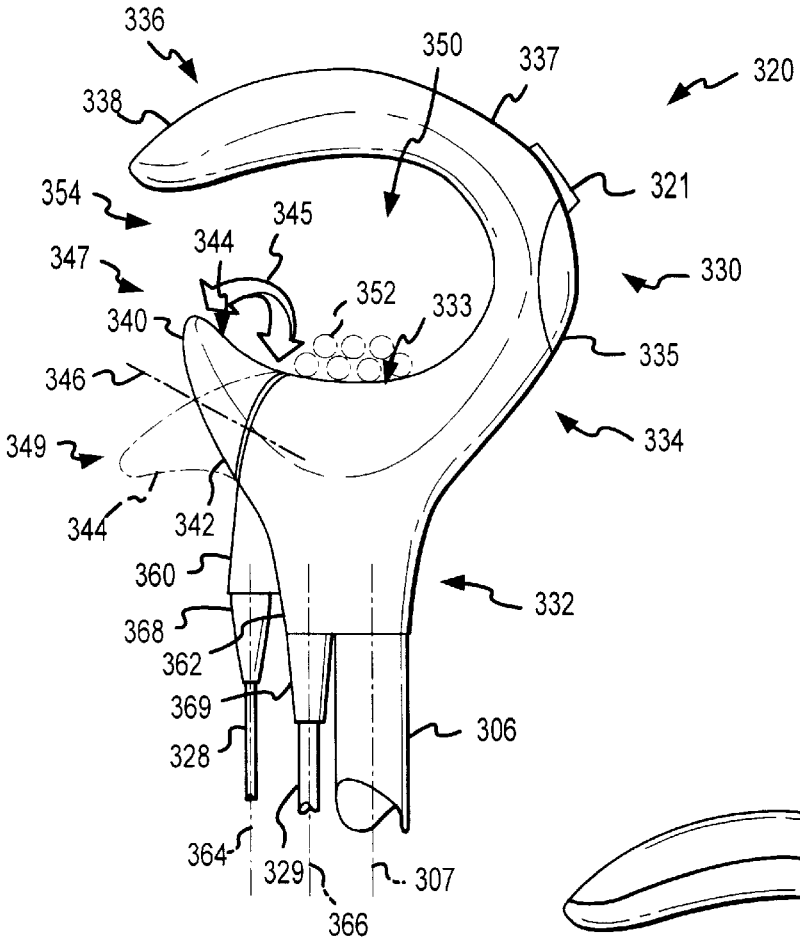
FIG. 5 is a side elevational view of the handle of FIG. 2.

FIG. 5 is a side elevational view of the handle assembly 320 of FIG. 2. The handle assembly 320 includes a main member 330 and a moveable retaining member 340. As described more fully below, the main member 330 partially surrounds a cord retaining space 350 sized to receive a plurality of loops (or "portions") 352 of the power cord 328 (shown in cross-sectional view in FIG. 5). The moveable retaining member 340 may be positioned to cooperate with the main member 330 to confine at least a portion of the power cord 328 within the cord retaining space 350, such as for storing the power cord 328 when the floor care device 100 is not in use.

The main member 330 includes a base portion 332, a lower portion 334, and an upper portion 336. The base portion 332 is attached to an upper end of the handle tube 306 such that a handle axis 307 of the handle tube 306 projects upwardly into the base portion 332. The lower portion 334 is connected to the base portion 332 and includes a forward section 335 that projects in a generally forwardly and upwardly direction from the base portion 332. The lower portion 334 also includes a concave outer surface 333 adjacent the cord retaining space 350.

The base portion 332 may be attached to the handle tube 306 in a variety of ways known to persons of ordinary skill in the art, such as by sliding the upper end of the handle tube 306 into a receiving aperture disposed in the base portion 302. The handle tube 306 may be secured into engagement with the base portion 332 using, for example, a set screw (not shown) or other suitable fastening device. The handle assembly 320 may be made by any of a variety of known means, including injection molding using a thermoplastic or thermosetting resin. If the handle assembly comprises a plurality of such injection molded components, such components may be fastened together by vibratory bonding, adhesives, screws or other fasteners, or by other means known in the art. Preferably, the material of which the main components of the handle assembly are made is capable of withstanding impacts that may occur from an operator's dropping of the handle assembly 320.

Referring again to FIG. 5, the upper portion 336 of the main member 330 includes a first section 337 and a second section 338. The first section 337 is coupled to the forward section 335 of the lower portion 334 and projects in a generally rearwardly and upwardly direction therefrom. The second section 337 is coupled to the first section 337 and projects in a generally rearwardly and downwardly direction therefrom. Preferably, the upper portion 336 is sized to be comfortably and conveniently gripped by the operator, and the cord retaining space 350 is sized to comfortably receive both the plurality of power cord loops 352 and the user's fingers for ease of handling of the floor care device 100.

In this embodiment, the retaining member 340 of the handle assembly 320 is a generally "horn-shaped" member that somewhat resembles a cone, but having a curved central axis, an oblong cross-sectional shape, and a rounded tip. The retaining member 340 includes a base 342 rotatably coupled to the main member 330, and a retaining surface 344. The retaining member 340 is spaced apart from the upper portion 336 of the main member 330 to define a wrapping opening 354 leading to the cord retaining space 350.

The retaining member 340 is rotatable (as indicated by arrow 345) about a retaining axis 346 between a first or "retaining" position 347, and a second or "releasing" position 349. In the retaining position 347, the retaining surface 344 is proximate to and aligned with the concave outer surface 333 of the main member 330, and is approximately smoothly continuous therewith. On the other hand, in the releasing position 347, the retaining surface 344 is rotated away from the outer surface 333 of the main member 330 such that it is remote from and not smoothly continuous with, the outer surface 333. The retaining member 340 may be attached to the main member 330 using a variety of attachment mechanisms that prevent the retaining member 340 from rotating freely between the retaining and releasing positions 347, 349, but that allow the retaining member 340 to be rotated between the retaining and releasing positions 347, 349 as desired by the operator, such as, for example, by the application of sufficient force, or by the actuation of a release mechanism, or by other similar action. For example, a ball detent could be used as a restraining mechanism to maintain the retaining member 340 in the retaining and releasing positions 347, 349 until rotated out of such positions by the application of a sufficient twisting force. Other known means may be used for maintaining the retaining member 340 in the appropriate positions.

Figure 1:
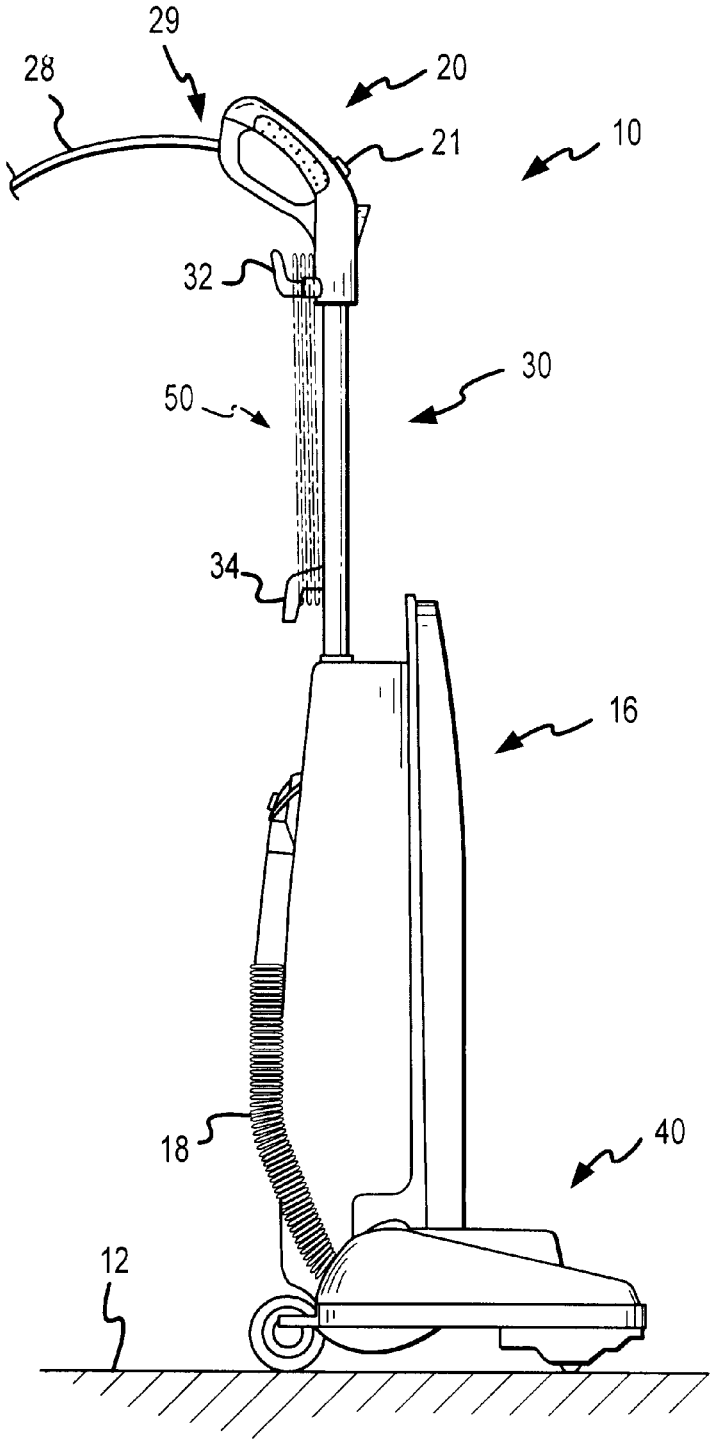
PRIOR ART FIG.1
FIG. 1 is a side elevational view of a floor care apparatus in accordance with the prior art.

In operation, the handle assembly 320 may be positioned with the retaining member 340 in the retaining position 347. The power cord 328 may be successively looped through the cord retaining space 350, such as by passing the plurality of loops 352 successively through the wrapping opening 354 and into the cord retaining space 350. The power cord 328 may also be looped about a lower cord-retaining member, such as the lower cord hook 34 of the type described above with reference to FIG. 1. Alternately, the secondary handle 328 may serve as the lower cord-retaining member.

In the retaining position 347, the retaining member 340 is positioned such that the retaining surface 344 is adjacent the cord retaining space 350 and the retaining member 340 cooperates with the main member 330 to confine the plurality of power cord loops 352 within the cord retaining space 350. The power cord 328 may thereby be quickly and conveniently retained for storage or transport of the floor care device 100.

When an operator desires to release the power cord 328, the retaining member 340 may be moved to the releasing position 349. In this position, the retaining surface 344 is moved away from the cord retaining space 350 so that the retaining member 340 does not cooperate with the main member 330 to confine the plurality of power cord loops 352 within the cord retaining space 350, and the loops 352 may be simultaneously removed from the cord retaining space 350. Also, the wrapping opening 354 is enlarged when the retaining member 340 is moved from the retaining position 347 to the releasing position 349. Thus, the plurality of power cord loops 352 may be quickly and conveniently removed from the cord retaining space 350.

The handle assembly 320 advantageously permits the operator of the floor care device 100 to quickly and efficiently store or release the power cord 328. Unlike the prior art cord retaining members, the handle assembly 320 provides a relatively larger wrapping opening 354 for accessing the cord retaining space 350. The operator may thereby wrap the plurality of loops 352 through the wrapping opening 354 more quickly and conveniently. Furthermore, the moveable retaining member 340 allows the user to easily switch between the retaining position 347 for storing the power cord 328, and the releasing position 349 for releasing the power cord 328 for operation.

Although the handle assembly 320 has been described with reference to a particular floor care device 100, namely an upright vacuum, one may note that the handle assembly 320 may be used on a wide variety of floor care devices. For example, handle assemblies in accordance with the invention may be used on buffers, extractors, steam cleaners, sweepers, carpet shampooers, and other similar devices having a power cord. Therefore, handle assemblies disclosed herein should not be construed as being limited to upright vacuums.

Furthermore, numerous alternate handle assemblies may be conceived in accordance with the invention. Several alternate embodiments of handle assemblies are described below. Generally, in the following discussion, where the construction and operation of alternate embodiments is substantially similar to previously described embodiments, the common elements and features are identified by the same reference numbers used above. Only significant differences in construction or operation are described in detail.

Figure 6:
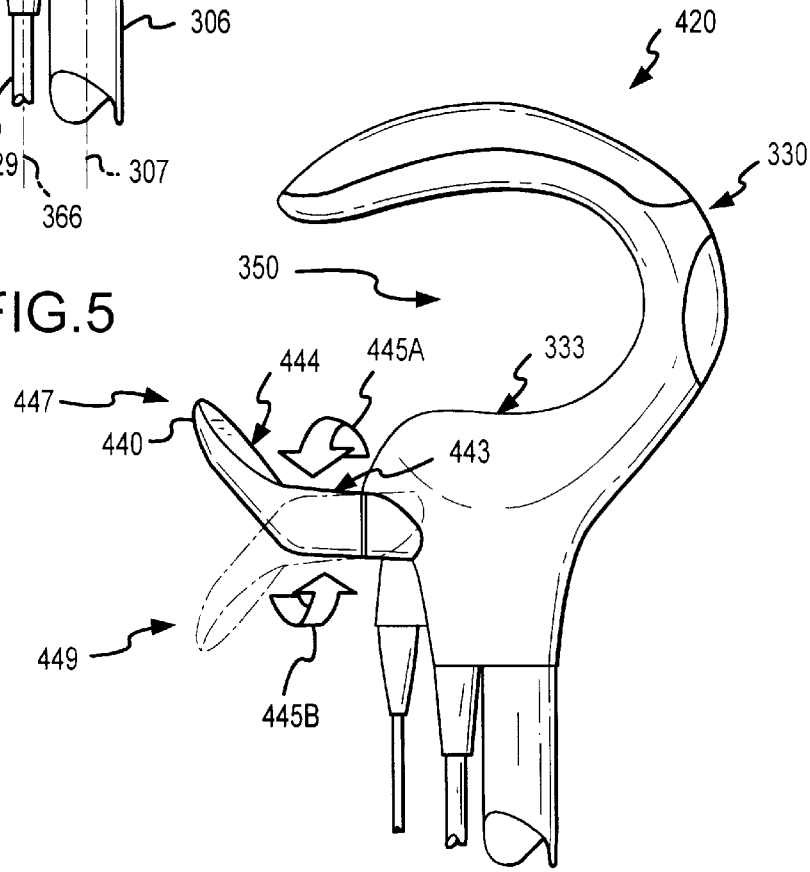
FIG. 6 is a side elevational view of a handle in accordance with an alternate embodiment of the invention.

FIG. 6 is a side elevational view of a handle assembly 420 in accordance with an alternate embodiment of the invention. In this embodiment, the handle assembly 420 includes an approximately hook-shaped retaining member 440 rotatably attached to a main member 430. The retaining member 440 includes a retaining surface 444 having a flattened portion 443. The retaining member 440 is rotatable in first and second directions 445A, 445B between a retaining position 447 and a releasing position 449. Again, the retaining member 440 may be attached to the main member 430 using an attachment mechanism that prevents the retaining member 440 from rotating freely between the retaining and releasing positions 447, 449, and allows the retaining member 440 to be rotated between the retaining and releasing positions 447, 449 as desired by the operator.

In the retaining position 447, the retaining surface 444 cooperates with the main surface 333 of the main member 330 to retain the plurality of power cord loops 352 (not shown). Unlike the embodiment described above, however, the retaining surface 444 of the handle assembly 420 is not continuously smooth with the outer surface 333 of the main member 330. In the releasing position 449, the plurality of power cord loops 352 slip easily off of the retaining member 440.

Figure 7:
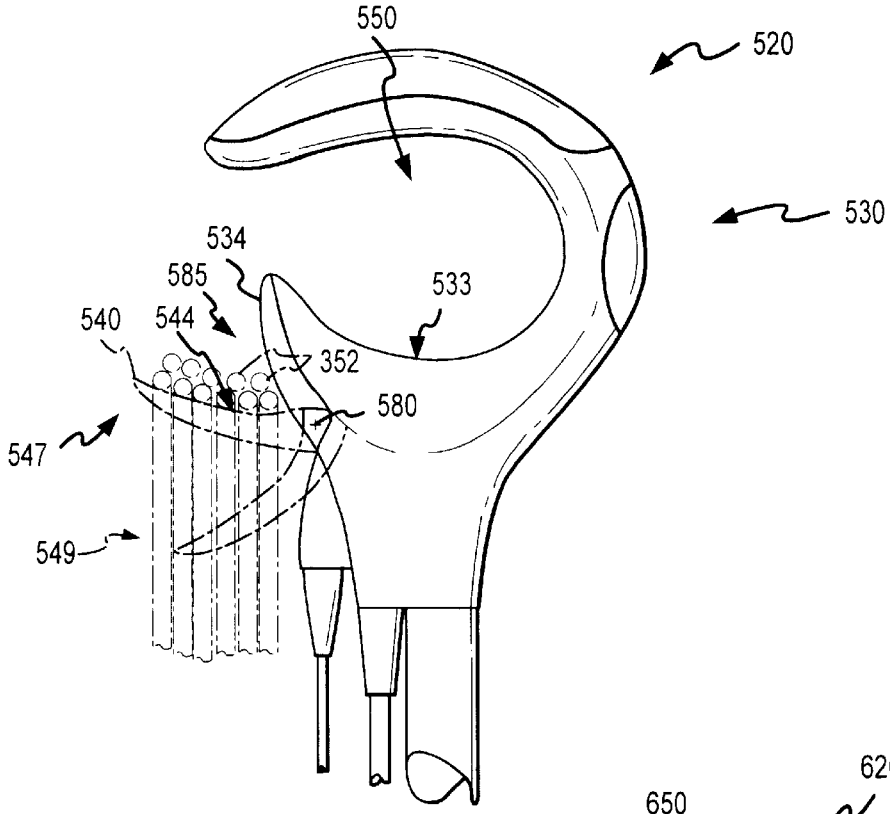
FIG. 7 is a side elevational view of a handle in accordance with another alternate embodiment of the invention.

FIG. 7 is a side elevational view of a handle assembly 520 in accordance with another embodiment of the invention. In this embodiment, a main member 530 partially surrounds and defines a grip space 550, and includes a concave outer surface 533 adjacent the grip space 550. A retaining member 540 is pivotably attached to the main member 530 and rotates with respect to the main member 530 about a pivot axis 580. The retaining member 540 includes a retaining surface 544. The main member 530 includes a convex outer surface 534 proximate the retaining member 540.

As shown in FIG. 7, the retaining member 540 is pivotable between a retaining position 547 and a releasing position 549. In the retaining position 547, the retaining surface 544 is spaced apart from the convex outer surface 534 of the main member 530 to create a cord retaining space 585. Thus, in this embodiment, the retaining surface 544 cooperates with the convex outer surface 534 of the main member 530 to form the cord retaining space 585. A plurality of power cord loops 352 may then be successively wrapped over the retaining surface 544. If necessary or desired, the grip space 550 may also be used to retain some of the power cord loops 352. In the releasing position 549, the retaining member 540 is pivoted downwardly, allowing the plurality of power cord loops 352 to slip off of the retaining surface 544 and be released from the cord retaining space 585.

Figure 8:
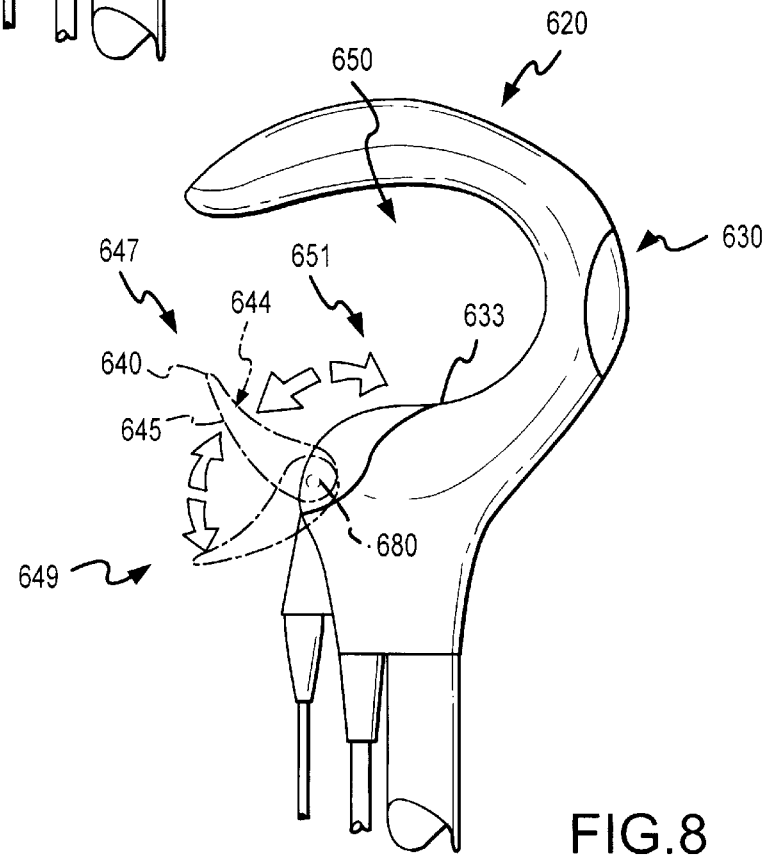
FIG. 8 is a side elevational view of a handle in accordance with yet another alternate embodiment of the invention.

FIG. 8 is a side elevational view of a handle assembly 620 in accordance with yet another alternate embodiment of the invention. In this embodiment, the handle assembly 620 includes a main member 630 that partially surrounds and defines a cord retaining space 650, and includes a main outer surface 633 adjacent the cord retaining space 650. A retaining member 640 is pivotably attached to the main member 630 and rotates with respect to the main member 630 about a pivot axis 680. The retaining member 640 includes a retaining surface 644 and a contoured outer surface 645.

The retaining member 640 is pivotable between a retaining position 647, a releasing position 649, and a stowed position 651. In the retaining position 647, the retaining surface 644 is adjacent to the cord retaining space 650 and cooperates with the main outer surface 633 of the main member 630 to retain a plurality of power cord loops 352 (not shown) within the cord retaining space 650. In the releasing position 649, the retaining member 640 is pivoted downwardly, allowing the plurality of power cord loops 352 to slip over the retaining surface 644 and out of the cord retaining space 650. In the stowed position 651, the retaining member 640 is positioned with the retaining surface 644 engaged against the main member 630, and the contoured outer surface 645 of the retaining member 640 is smoothly continuous with the main outer surface 633 of the main member 630. The handle assembly 620 advantageously allows the retaining member 640 to be stowed so that it will not interfere with the operator's grip on the main member 630 and will not be damaged during use of the floor care device.

Figure 9:
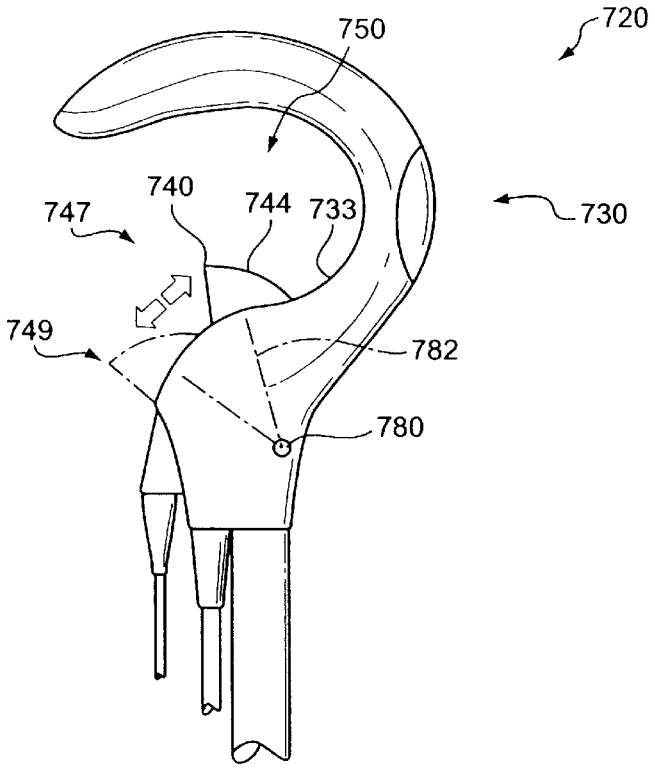
FIG. 9 is a side elevational view of a handle in accordance with a further alternate embodiment of the invention.
Figure 9A:
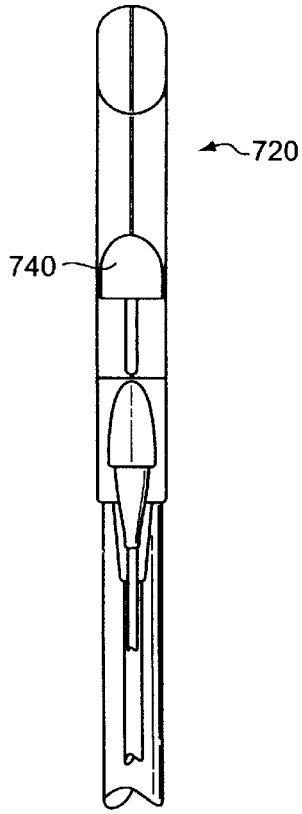
FIG. 9A is a front view of the embodiment shown in FIG. 9.
Figure 9B:
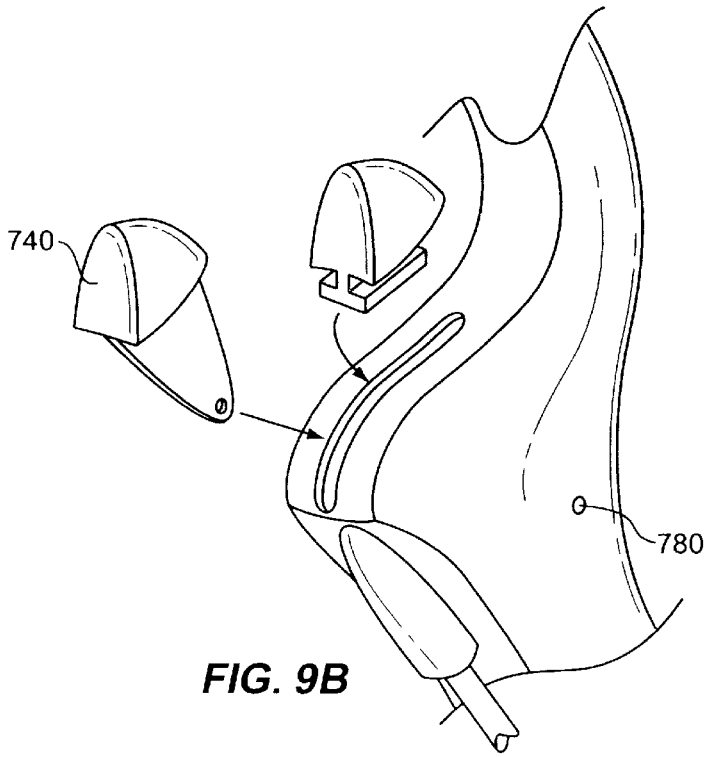
FIG. 9B is an exploded isometric view of the embodiment shown in FIG. 9 and 9A.

FIGS. 9, 9A and 9B are side elevational, front elevational and exploded isometric views of handle assembly 720 in accordance with a further alternative embodiment of the invention. In this embodiment, the handle assembly 720 includes a main member 730 and a retaining member 740 that is slideably attached with the main member 730. The main member 730 partially surrounds and defines a cord retaining space 750. The retaining member 740 includes a retaining surface 744, and is slideably attached to main surface 733 by a T-member 790 formed into the retaining member 740 and is slideably moveable along the main surface 733 using slot 795 between a retaining position 747 and a releasing position 749. Alternately, the retaining member 740 may be pivotably attached to the main member 730 by a pivot arm 782 and may pivotably move with respect to the main member 730 about a pivot line 780.

In the retaining position 747 (FIG. 9), the retaining surface 744 more fully cooperates with a main surface 733 of the main member 730 to retain the plurality of power cord loops 352 (not shown) within the cord retaining space 750. In the releasing position 749, the retaining surface 744 is more smoothly continuous with the main surface 733, allowing the plurality of power cord loops 352 to slip over the retaining member 740 and out of the cord retaining space 750.

Referring again to FIG. 5, in another aspect, the base portion 332 of the handle assembly 320 may also include a first receiving portion 360 coupled to the power cord 328, and a second receiving portion 362 coupled to the control cord 329. The power cord 328 is attached to the first receiving portion 360 such that a first axis 364 of the power cord 328 projects into the base portion 332 and is approximately parallel to the handle axis 307. Similarly, the control cord 329 is attached to the second receiving portion 362 such that a second axis 366 of the control cord 329 projects into the base portion 332 and is approximately parallel to the handle axis 307. The power cord 328 may include a first reinforcing portion 368, and the control cord 329 may include a second reinforcing portion 369, to reinforce the attachment between the cords 328, 329 and the receiving portions 360, 362, respectively.

In operation, when the operator begins preparing the floor care device 100 for transport or storage, the operator may pull downwardly on the power cord 328, drawing the power cord 328 tightly around the lower cord-retaining member (e.g. the lower cord hook 34 or a secondary handle 312) before drawing the power cord 328 upwardly to the cord retaining space 350 defined by the handle assembly 320. Because the power cord 328 is attached to the first receiving portion 360 such that the first axis 364 of the power cord 328 projects into the base portion 332 and is approximately parallel to the handle axis 307, the bending stresses that may be induced in the power cord 328 are greatly reduced compared with prior art devices. At the attachment point between the power cord 328 and the first receiving portion 360, the forces generated within the power cord 328 by the operator during wrapping of the cord are predominantly axial forces. Bending forces that may fatigue and ultimately damage the power cord 328 at the point of attachment are thereby greatly reduced or eliminated.

Another advantage of the handle assembly 320 is that when the handle support 300 is pivoted or released into a fully inclined position, a portion of the handle assembly 320 will contact the floor surface 220 first rather than a portion of the power cord 328. For example, when the secondary handle 312 is eliminated or is positioned in the folded position adjacent the handle tube 306, the handle support 300 may be inclined until part of the handle assembly 320 contacts the floor surface 220. Depending on the handle assembly embodiment, the part of the handle assembly that contacts the floor surface may be the upper portion of the main member, or the retaining member, or the first receiving portion. The power cord, however, projects downwardly along the handle support and does not bear the force of striking the floor surface. Thus, if the operator lowers or accidentally releases the handle assembly 320, the force of contact is borne by the handle assembly 320 rather than the power cord 328. The handle assembly 320 may thereby advantageously reduce or eliminate undesirable bending stresses that may damage the power cord 328.

The detailed descriptions of the above embodiments are not exhaustive descriptions of all embodiments contemplated by the inventors to be within the scope of the invention. Indeed, persons skilled in the art will recognize that certain elements of the above-described embodiments may variously be combined or eliminated to create further embodiments, and such further embodiments fall within the scope and teachings of the invention. It will also be apparent to those of ordinary skill in the art that the above-described embodiments may be combined in whole or in part to create additional embodiments within the scope and teachings of the invention.

Thus, although specific embodiments of, and examples for, the invention are described herein for illustrative purposes, various equivalent modifications are possible within the scope of the invention, as those skilled in the relevant art will recognize. The teachings provided herein can be applied to other handle assemblies for floor care devices, and methods for using the same, and not just to the embodiments described above and shown in the accompanying figures. Accordingly, the scope of the invention should be determined from the following claims.

What is claimed is:

1. A handle assembly for a floor care device having a handle support and a power cord, comprising:

a main member partially surrounding a cord retaining space adapted to receive a plurality of portions of the power cord and including a base portion adapted to attach to the handle support and a main surface adjacent the cord retaining space;

a lower portion coupled to the base portion and having a forward section projecting forwardly and upwardly from the base portion;

an upper portion coupled to the forward section of the lower portion and having a first section projecting upwardly and rearwardly from the forward section and a second section projecting downwardly from the first section; and a retaining member moveably attached to the main member and having a retaining surface adjustably positionable proximate the cord retaining space, the retaining member being movable between a first position in which the retaining surface cooperates with the main surface to be adapted to at least partially retain the plurality of power cord portions within the cord retaining space, and a second position in which the retaining surface cooperates with the main surface to be adapted to release the plurality of power cord portions from the cord retaining space.

2. The handle assembly according to claim 1 wherein the retaining member is moveably attached to the base portion.

3. The handle assembly according to claim 1 wherein the retaining member is rotatably attached to the main member.

4. The handle assembly according to claim 1 wherein the retaining member is pivotably attached to the main member.

5. The handle assembly according to claim 1 wherein the retaining member is slidably attached to the main member.

6. The handle assembly according to claim 1, further comprising a restraining mechanism for releasably maintaining the retaining member in the first or second positions.

7. The handle assembly according to claim 1 wherein the retaining member includes a base end attached to the main member and a second end projecting away from the main member, the second end being spaced a greater distance from the main member when the retaining member is in the second position than when the retaining member is in the first position.

8. The handle assembly according to claim 1 wherein the retaining member comprises a generally cone-shaped member having a curved central axis, an oblong cross-sectional shape and a base end rotatably attached to the main member and wherein the retaining surface is at least partially concave.

9. A handle assembly for a floor care device having a handle support and a power cord, comprising:

a main member partially surrounding a cord retaining space adapted to receive a plurality of portions of the power cord and including a base portion adapted to attach to the handle support and a main surface adjacent the cord retaining space; and a retaining member moveably attached to the main member and having a retaining surface adjustably positionable proximate the cord retaining space, the retaining member being movable between a first position in which the retaining surface cooperates with the main surface to be adapted to at least partially retain the plurality of power cord portions within the cord retaining space and further the retaining surface being substantially continuous with the main surface when the retaining member is in the first position, and a second position in which the retaining surface cooperates with the main surface to be adapted to release the plurality of power cord portions from the cord retaining space.

10. The handle assembly according to claim 1 wherein the cord retaining space is at least partially disposed between the upper and lower portions, the lower portions including at least a portion of the main surface.

11. The handle assembly according to claim 1 wherein at least part of the retaining surface is substantially continuous with the main surface when the retaining member is in the first position.

12. The handle assembly according to claim 1 wherein the retaining member is moveable to a third position in which the retaining surface is engaged against the main member.

13. A handle assembly for a floor care device having a handle support and a power cord, comprising:

a main member partially surrounding a gripping space and including a base portion adapted to attach to the handle support and an outer surface adjacent the gripping space;

a lower portion coupled to the base portion and having a forward section projecting forwardly and upwardly from the base portion;

an upper portion coupled to the forward section of the lower portion and having a first section projecting upwardly and rearwardly from the forward section and a second section projecting downwardly from the first section;

wherein the gripping space is at least partially disposed between the upper and lower portions; and a retaining member moveably attached to the main member and having a retaining surface adjustably positionable proximate the outer surface, the retaining member being movable between a first position in which the retaining surface cooperates with the outer surface to form a cord retaining space adapted to at least partially retain a plurality of loops of a power cord, and a second position in which the retaining surface cooperates with the outer surface to be adapted to release the plurality of power cord portions from the cord retaining space.

14. The handle assembly according to claim 13 wherein the retaining member is moveably attached to the base portion.

15. The handle assembly according to claim 13 wherein the retaining member is rotatably attached to the main member.

16. The handle assembly according to claim 13 wherein the retaining member is pivotably attached to the main member.

17. A floor care device having a floor engaging head, a power cord operatively coupled to the floor engaging head, a handle support attached to and projecting away from the floor engaging head, and a handle assembly, the handle assembly comprising:

a main member partially surrounding a cord retaining space adapted to receive a plurality of portions of the power cord and including a base portion adapted to attach to the handle support and a main surface adjacent the cord retaining space;

a lower portion coupled to the base portion and having a forward section projecting forwardly and upwardly from the base portion;

an upper portion coupled to the forward section of the lower portion and having a first section projecting upwardly and rearwardly from the forward section and a second section projecting downwardly from the first section; and a retaining member moveably attached to the main member and having a retaining surface adjustably positionable proximate the cord retaining space, the retaining member being movable between a first position in which the retaining surface cooperates with the main surface to be adapted to at least partially retain the plurality of power cord portions within the cord retaining space and further the retaining surface being substantially continuous with the main surface when the retaining member is in the first position, and a second position in which the retaining surface cooperates with the main surface to be adapted to release the plurality of power cord portions from the cord retaining space.

18. The floor care device according to claim 17 wherein the retaining member is rotatably attached to the main member.

19. The floor care device according to claim 17 wherein the retaining member is pivotably attached to the main member.

20. The floor care device according to claim 17 wherein the retaining member comprises a generally cone-shaped member having a curved central axis, an oblong cross-sectional shape and a base end rotatably attached to the main member and wherein the retaining surface is at least partially concave.

21. The floor care device according to claim 17 wherein the cord retaining space is at least partially disposed between the upper and lower portions, the lower portion including at least a portion of the main surface.

22. The floor care device according to claim 17 wherein the floor engaging head includes an airflow propulsion device having a motor and a suction fan driveably coupled to the motor.

23. A handle assembly for a floor care device having an elongated handle support and a cord, comprising:

a main member having a grip portion adapted to be held by an operator of the floor care device, and a base portion attached to the grip portion, the base portion including, an attachment portion adapted to attach to a handle tube along a longitudinal handle axis of the handle tube, a first receiving portion proximate the attachment portion and adapted to attach to a first end of the cord along a longitudinal first axis, the first axis being approximately parallel to the handle axis, and a second receiving portion proximate the first receiving portion and adapted to attach to a second end of a second cord along a longitudinal second axis, the second axis being approximately parallel to the first axis.

24. The handle assembly according to claim 23 wherein the cord comprises a control cord, the handle assembly further comprising a control switch attached to the main member and operatively coupled to the first end of the control cord.

25. The handle assembly according to claim 23 wherein the main member partially surrounds a cord retaining space adapted to receive a plurality of portions of the cord and includes a main surface adjacent the cord retaining space, the handle assembly further comprising:

a retaining member moveably attached to the main member and having a retaining surface adjustably positionable proximate the cord retaining space, the retaining member being movable bet ween a first position in which the retaining surface cooperates with the main surface to be adapted to at least partially retain the plurality of cord portions with in the cord retaining space, and a second position in which the retaining surface cooperates with the main surface to be adapted to release the plurality of power cord portions from the cord retaining space.

26. The handle assembly according to claim 25 wherein the retaining member comprises a partially cone-shaped member having a curved central axis, an oblong cross-sectional shape and a base end rotatably attached to the main member, the retaining surface is at least partially concave.

27. A floor care device having a floor engaging head, a cord operatively coupled to the floor engaging head, an elongated handle support coupled to and projecting away from the floor engaging head, and a handle assembly, the handle assembly comprising:

a main member having a grip portion adapted to be held by an operator of the floor care device, and a base portion attached to the grip portion, the base portion including, an attachment portion adapted to attach to a handle tube along a longitudinal handle axis of the handle tube, a first receiving portion proximate the attachment portion and adapted to attach to a first end of the cord along a longitudinal first axis, the first axis being approximately parallel to the handle axis, and a second receiving portion proximate the first receiving portion and adapted to attach to a second end of a second cord along a longitudinal second axis, the second axis being approximately parallel to the first axis.

28. The floor care device according to claim 27 wherein the cord comprises a control cord, the handle assembly further comprising a control switch attached to the main member and operatively coupled to the first end of the control cord.

29. The floor care device according to claim 27 wherein the main member partially surrounds a cord retaining space adapted to receive a plurality of portions of the cord and includes a main surface adjacent the cord retaining space, the handle assembly further comprising:

a retaining member moveably attached to the main member and having a retaining surface adjustably positionable proximate the cord retaining space, the retaining member being movable between a first position in which the retaining surface cooperates with the main surface to be adapted to at least partially retain the plurality of cord portions within the cord retaining space, and a second position in which the retaining surface cooperates with the main surface to be adapted to release the plurality of power cord portions from the cord retaining space.

30. The floor care device according to claim 27 wherein the floor engaging head includes an airflow propulsion device having a motor and a suction fan driveably coupled to the motor.

31. A handle assembly for a floor care device having a handle support and a power cord, comprising:

a main member adapted to attach to the handle support and including a main surface;

a retaining member moveably attached to the main member and being movable between a first position in which the retaining member cooperates with the main surface to at least partially retain a plurality of portions of the power cord, and a second position in which the retaining member cooperates with the main surface to release the plurality of power cord portions; and wherein the power cord originates in the handle assembly.

32. The handle assembly according to claim 31 wherein the retaining member is moveably attached to the base portion.

33. The handle assembly according to claim 31 wherein the retaining member is rotatably attached to the main member.

34. The handle assembly according to claim 31 wherein the retaining member is pivotably attached to the main member.

35. The handle assembly according to claim 31 wherein the retaining member is slidably attached to the main member.

36. A method of placing a power cord of a floor care device in a secure position, comprising:

providing a handle assembly having a main member that partially surrounds a cord retaining space adapted to receive a plurality of portions of the power cord and that includes, a main surface proximate the cord retaining space, a base portion adapted to attach a handle support of the floor care device, a lower portion coupled to the base portion and having a forward section projecting forwardly and upwardly from the base portion, and an upper portion coupled to the forward section of the lower portion and having a first section projecting upwardly and rearwardly from the forward section and a second section projecting downwardly and rearwardly from the first section, the upper and lower portions partially surrounding a cord retaining space;

providing a moveable retaining surface proximate the main surface, the retaining surface being movable between a retaining position in which the retaining surface more fully cooperates with the main surface to more fully retain the plurality of power cord portions within the cord space, and a releasing position in which the retaining surface less fully cooperates with the main surface to less fully confine the plurality of power cord portions within the cord retaining space;

positioning the moveable retaining surface in the retaining position; and positioning at least some of the plurality of power cord portions within the cord retaining space.

37. The method according to claim 36 wherein positioning the retaining surface in the retaining position comprises rotating the retaining surface into the retaining position.

38. The method according to claim 36 wherein positioning the retaining surface in the retaining position comprises pivoting the retaining surface into the retaining position.

39. The method according to claim 36 herein positioning the retaining surface in the retaining position comprises sliding the retaining surface into the retaining position.

* * * * *